United States Patent [19]

Knight

[11] Patent Number: 4,700,499

[45] Date of Patent: Oct. 20, 1987

[54] MUZZLE-LOADING RIFLE

[76] Inventor: William A. Knight, R.R. 5, Box 110-A, Unionville, Mo. 63565

[21] Appl. No.: 819,740

[22] Filed: Jan. 21, 1986

[51] Int. Cl.[4] ..... F41C 7/00; F41C 17/04

[52] U.S. Cl. ..... 42/51; 42/70.08

[58] Field of Search ..... 42/51, 83, 70.04, 70.08

[56] References Cited

U.S. PATENT DOCUMENTS

| | | | |
|---|---|---|---|
| 158,221 | 12/1874 | Smith | 42/51 |
| 269,152 | 12/1882 | Zundorff | 42/16 |
| 398,595 | 2/1889 | Emmens . | |
| 1,160,343 | 11/1915 | Tomaszewski | 42/70.01 |
| 2,102,199 | 12/1937 | Dixon | 42/70.08 |
| 2,374,378 | 4/1945 | Rice | 42/70.08 |
| 3,397,474 | 8/1968 | Badali | 42/70.04 |
| 3,757,447 | 9/1973 | Rowe | 42/51 |
| 4,065,867 | 3/1978 | Storey | 42/69 |
| 4,163,335 | 8/1979 | Ives | 42/51 |
| 4,222,191 | 9/1980 | Lee et al. | 42/51 |
| 4,503,633 | 3/1985 | Davis | 42/51 |

*Primary Examiner*—Charles T. Jordan

*Attorney, Agent, or Firm*—Senniger, Powers, Leavitt and Roedel

[57] ABSTRACT

A muzzle-loading rifle of this invention generally comprises a barrel having an axial bore therethrough, and an elongate receiver formed integrally with the barrel at the breech end of the barrel. The receiver extends rearwardly from the barrel and has an axial bore therethrough generally coaxial with the bore through the barrel. At the rearward end of the receiver is and end cap having a bore therethrough which is generally coaxial with the receiver bore. A bolt of integral one-piece construction is slidable in the receiver bore between a retracted position and a firing position. The bolt has a body, a head at one end of its body, and an elongate tailpiece at the rearward end of its body. The tailpiece extends endwise from the bolt body through an end cap bore and projects rearwardly beyond the end cap to form a handle adapted to be grasped and pulled to slide the bolt to the retracted position without rotation. Spring means urges the bolt forward toward its firing position. Additional aspects of this invention include a double safety system and a bolt assembly which is removable as a unit.

17 Claims, 8 Drawing Figures

MUZZLE-LOADING RIFLE

BACKGROUND OF THE INVENTION

This invention relates generally to rifles, and more particularly to an improved muzzle-loading rifle.

Hunting with muzzle-loading rifles has been becoming increasingly popular in the last few years. Many hunters prefer to use muzzle-loading rifles because of nostalgia and the sporting ethic. With a muzzle-loader, a hunter has only one shot and, therefore, because a game animal has a greater chance to escape with its life, the hunter's skill can be more adequately tested. Some hunters also enjoy the muzzle-loading routine of pouring powder down the rifle barrel, packing it, and driving a shot down the barrel. Some states even have a different, special hunting season for sportsmen with muzzle-loading firearms.

Hunters, however, have had problems with the prior muzzle-loading firearms. Traditional muzzle-loading rifles use an intricate system of delicate springs and levers to ignite the charge. The complexity of the weapon is multiplied by an excessive number of parts. Instead of being one piece, the bolt typically comprises a large number of parts (anvil, bolt body, a bolt lever, etc.). Frequently, the small, intricate parts of these muzzle-loaders break, leaving the frustrated hunter out in the woods, often with a game animal in sight. Additionally, a bolt lever must be rotated to "cock" the rifle; if the lever is accidentally rotated out of its receiving groove, the rifle discharges. Moreover, prior muzzle-loaders either have one or no safety mechanism. Therefore, the hunter is taking the risk that the gun might inadvertantly discharge, causing injury.

SUMMARY OF THE INVENTION

Among the several objects of the invention may be noted the provision of an improved muzzle-loading rifle that is durable, accurate, safe, easy to load, easy to maintain and easy to use. Also, some other objects of this invention are the provision of a muzzle-loading rifle which is made up of a minimum number of parts and which has two safeties for an extra margin of safety.

Generally, a muzzle-loading rifle of the present invention comprises a barrel having an axial bore therethrough, and an elongate receiver formed integrally with the barrel at the breech end of the barrel. The receiver extends rearwardly from the barrel and has an axial bore therethrough generally coaxial with the bore through the barrel. At the rearward end of the receiver is an end cap having a bore therethrough which is generally coaxial with the receiver bore. A bolt of integral one-piece construction is slidable in the receiver bore between a retracted position and a firing position. The bolt has a body, a head at one end of its body, and an elongate tailpiece at the rearward end of its body. The tailpiece extends endwise from the bolt body through an end cap bore and projects rearwardly beyond the end cap to form a handle adapted to be grasped and pulled to slide the bolt to the retracted position without rotation. Spring means urges the bolt forward toward its firing position.

In a second aspect of this invention, the rifle comprises a barrel having an axial bore therethrough, and a receiver at the breech end of the barrel. The receiver has an axial bore therethrough generally coaxial with the bore through the barrel. At the rearward end of the receiver is an end cap having a bore therethrough which is generally coaxial with the receiver bore. A bolt is slidable in the receiver bore between a retracted position and a firing position. The bolt has a body, a head at a forward end of its body, and an elongate tailpiece at the rearward end of its body. The tailpiece extends endwise from the bolt body through an end cap bore and projects rearwardly beyond the end cap to form a handle adapted to be grasped and pulled to slide the bolt to the retracted position without rotation. Spring means urges the bolt forward toward its firing position. First safety means is adapted to be actuated to prevent the bolt from moving from its retracted position, and second safety means is adapted to be actuated to prevent the bolt from reaching its firing position. The second safety means comprises a safety member rotatable on the bolt tailpiece from a disengaged position wherein the bolt is able to move to its firing postion, to an engaged position forward of the disengaged position. At the engaged position, the safety member is engagable with the end cap as the bolt moves toward its firing position to limit the forward travel of the bolt and thereby prevent it from reaching its firing position.

In a third aspect of this invention, the rifle comprises a barrel having an axial bore therethrough, and a receiver at the breech end of the barrel. The receiver has an axial bore therethrough generally coaxial with the bore through the barrel. A bolt assembly comprising an end cap is detachably mounted at the rearward end of the receiver. The end cap has a bore therethrough generally coaxial with said receiver bore. A bolt is slidable in the bore of the receiver between a retracted position and a firing position. The bolt has a body, a head at the forward end of the body and an elongate tailpiece at the rearward end of the body. The tailpiece extends endwise from the body through the end cap bore and projects rearwardly beyond the end cap to form a handle adapted to be grasped and pulled to slide the bolt to the retracted position without rotation. Spring means on the tailpiece react against the end cap and the body of the bolt to urge the bolt forwardly toward its firing position. Toward the rearward end of the tailpiece is finger grip means for grasping the tailpiece to pull the bolt rearwardly to the retracted position. The end cap is adapted to be detached from the receiver whereby the bolt assembly may be removed as a unit from the rifle.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
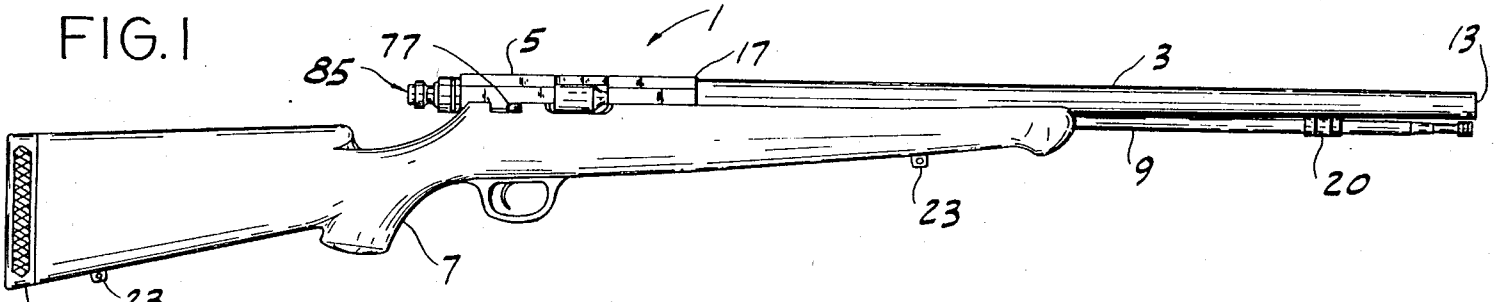
FIG. 1 is a side elevation of a muzzle-loading rifle of the present invention.

Referring to the drawings, a muzzle-loading rifle of the present invention is designated in its entirety by the reference numeral 1. As shown in FIG. 1, the rifle comprises a barrel 3, an elongate receiver 5, a stock 7 and a ramrod 9. The barrel 3 has an axial bore 11 therethrough extending from its front end 13 to its breech end 15. The diameter of bore 11 is preferably 30–60 caliber. It preferably has rifling and is of suitable length (e.g., 24 in.).

Figure 2:
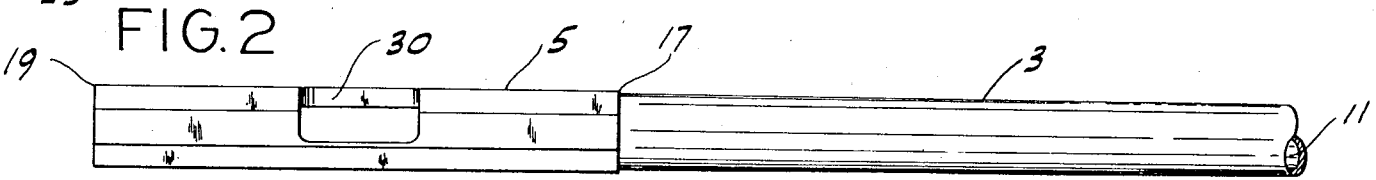
FIG. 2 is an enlarged side view showing an integrally formed receiver and barrel unit for the muzzle-loading rifle of FIG. 1.

As shown in FIGS. 1 and 2, the barrel 3 and receiver 5 are preferably integrally formed from one piece of material (steel is suggested), with the receiver 5 extending rearwardly from the breech (rearward) end of the barrel. The barrel and receiver combination may be machined from an octogan barrel blank, preferably measuring one inch across the flats and 30–32 in. long. Starting at its front end 13 and ending at the receiver's forward end 17, the blank is machined down into a generally cylindrical shape, tapering toward the front end 13. The length of the receiver 5, from its forward end 17 to its rearward end 19, is preferably about seven inches. The receiver 5 may retain the octogan shape of the rifle blank. It may, also, be suitably drilled and tapped (not shown) to accept screwthreads for scope mounting. A bushing 20 may be welded or brazed on the barrel 3 for retaining the ramrod 9. The barrel 3 and receiver 5 may then be coated with a synthetic fluorine-containing resin (sometimes sold under the "Teflon" trademark), so that it will not rust or reflect light.

Referring again to FIG. 1, the stock 7 is attached to the receiver 5 in a conventional manner, such as with a recoil lug and countersunk screw (not shown). The stock 7 may be of quality hardwood, such as walnut. In order to reduce the force transmitted to a shoulder during discharge, a recoil pad 21 may be attached to the rear of the stock 5. Swivel studs 23 may be installed on the bottom of the stock 5 for attaching a rifle strap (not shown).

Referring to FIGS. 4–7, the receiver 5 has a large axial bore 25 therein generally coaxial with the barrel bore 11. Bore 25 has a diameter (e.g., $\frac{5}{8}$ in.) somewhat greater than that of bore 11 and extends from the rear end 19 of the receiver forward to a shoulder 27 immediately to the rear of bore 11. The rearward end of bore 11 is threaded as indicated at 29 for accepting a breech plug 31. The breech plug 31 has a bore 35 therethrough generally coaxial with the barrel and receiver bores (11 and 25, respectively). The bore 35 has a first relatively large-diameter section 35A adjacent the rearward end of the plug, a second relatively small-diameter section 35B at the forward end of the plug, and a tapered transition section 35C between the first and second bore sections. The breech plug 31 has a slotted head 37 for receiving a wrench.

A nipple 39 is threadably (and thus removably) mounted in the bore section 35A, which allows the nipple to be readily replaced. The nipple 39, which is adapted to hold a firing cap 41 thereon, has an internal bore 43. The bore 43, transition section 35C and forward bore section 35B combine to make up what is commonly referred to as a "flash hole". Preferably, bore section 35B is funneled (the diameter adjacent the forward end of the plug being relatively large and the diameter at the rearward end of the bore section being relatively small) to efficiently allow gun powder to fill the flash hole, thereby improving combustion of the powder. An access hole 30 is milled in the receiver for loading and unloading the firing cap 41.

Figure 8:
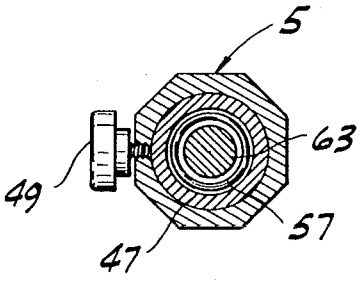
FIG. 8 is a cross sectional view taken along line 8—8 in FIG. 7.

As indicated at 45, the receiver bore 25 is threaded at its rearward end for accepting an end cap 47, which may be additionally (or alternatively) secured in place by a lock screw 49 (FIG. 8). End cap 47 preferably has a bore 51 therethrough ($\frac{3}{8}$" suggested diameter) coaxial with the receiver bore 25.

Figure 3:
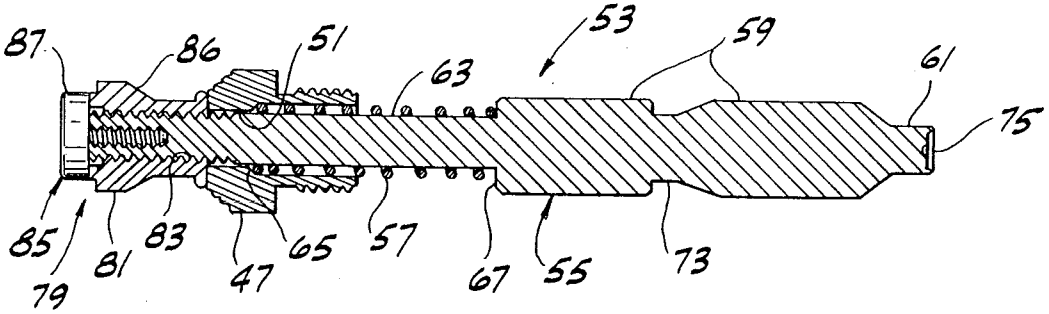
FIG. 3 is a side view, partly in cross section, of a bolt assembly for the muzzle-loading rifle of FIG. 1.

A bolt assembly 53 of the rifle is illustrated in FIGS. 3–7. Referring specifically to FIG. 3, this assembly 53 comprises a bolt generally designated 55, a bolt spring 57 and end cap 47. The bolt 55 has a generally cylindric body 59, a conical head 61 and an elongate tailpiece 63. Spring 57 reacts at its rearward end against a forwardly facing internal shoulder 65 in the end cap bore 51 and at its forward end against a rearwardly facing spring retaining shoulder 67 at the back end of the bolt body 59 to urge the bolt 55 forward toward a firing position (FIG. 6) in which the head 61 of the bolt is adapted to strike and ignite the firing cap 41 on nipple 39. The elongate tailpiece 63 extends endwise from the rearward end of bolt body 59 (at the shoulder 67) through the end cap bore 51, projecting rearwardly beyond the end cap 47. The bolt body 59 and tailpiece 63 are sized so that they may slide within the receiver bore 25 and end cap bore 51, respectively. The tailpiece 63, end cap 47, and/or the receiver bore 25 may be coated with a low-friction synthetic resin (e.g., "Teflon") to reduce friction.

Figures 4, 5, 6:
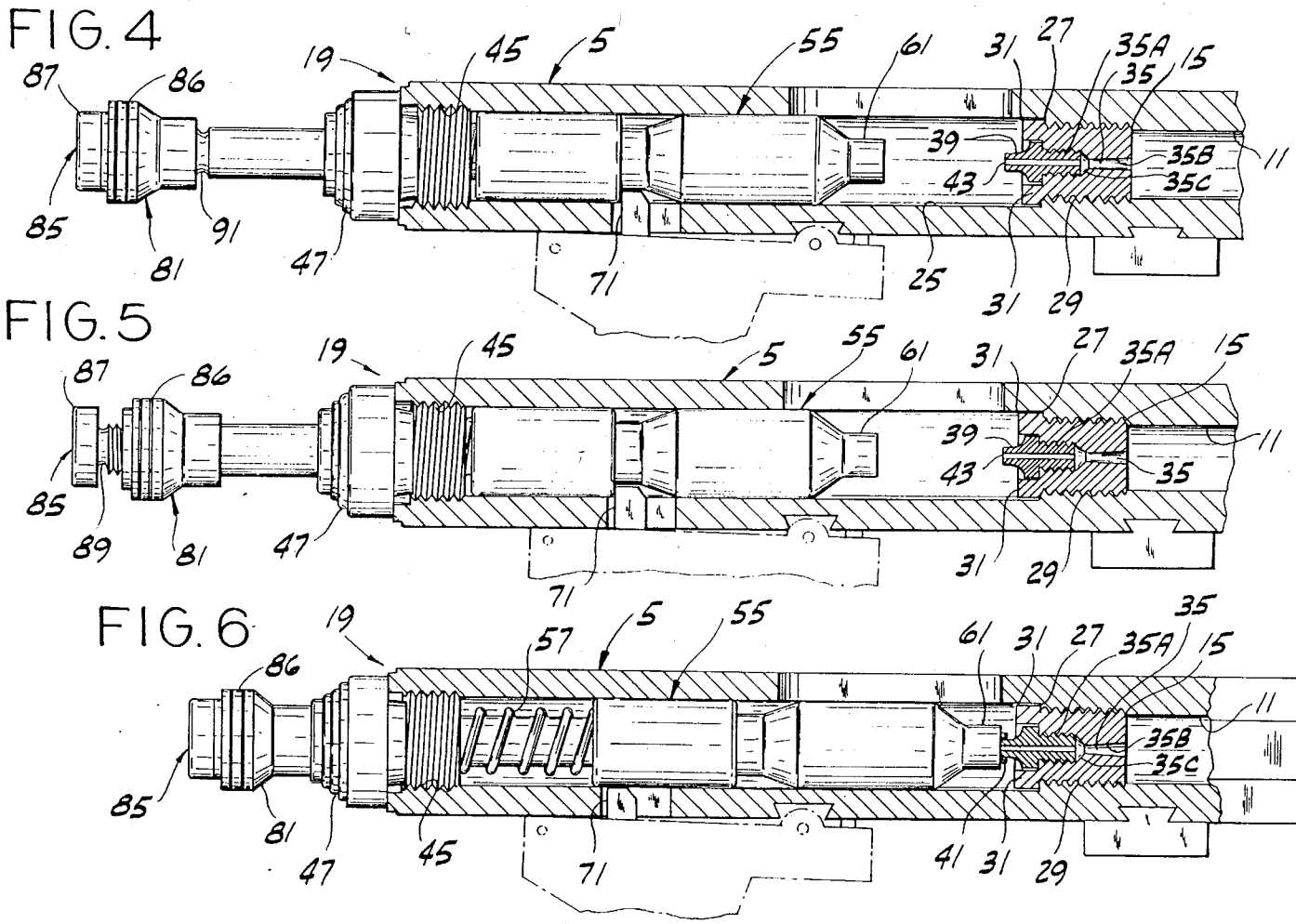
FIG. 4 is a side view, partly in cross section, of a portion of the muzzle-loading rifle of FIG. 1 showing the bolt cocked and a second safety in the disengaged position.
FIG. 5 is a view similar to FIG. 4 showing the bolt cocked and the second safety in an engaged position.
FIG. 6 is a view similar to FIG. 4 showing the bolt in its fired position.

The tailpiece 63 functions as a handle and is adapted to be grasped and pulled to slide the bolt rearwardly from its firing position (FIG. 6) to a retracted (or "cocked") position (FIG. 4). The bolt is held in its retracted position against the bias of the spring 57 by means of a spring-loaded trigger sear 71 receivable in an annular groove 73 in the body 59 of the bolt 55. It will be understood that, unlike conventional muzzle-loading rifles, the bolt 55 is not rotated as it is pulled rearwardly to its retracted position.

Referring to FIG. 3, the head 61 of the bolt 55 has a recess 75 therein sized to receive the firing cap 41 on nipple 39 when the bolt reaches its firing position. This serves to suppress "flash back" and direct fire from the firing cap into the "flash hole" (43, 35B and 35C). It also causes the firing cap to "banana peel" when struck, making the firing cap easy to remove after use.

In accordance with another aspect of the present invention, rifle 1 has two safety mechanisms for added protection during loading, climbing and running. The first is a traditional trigger safety adapted to be actuated by pushing a trigger safety lever 77, which locks the trigger and thereby prevents the bolt 55 from being released to move to its firing position (See FIG. 1). This constitutes first safety means for preventing the bolt from moving from its retracted positon. The second safety mechanism, indicated generally at 79, comprises a safety member 81 rotatably mounted on a threaded portion 83 of the bolt tailpiece 63, and a lock screw 85 threaded into the rearward end of the tailpiece 63. Safety member 81 preferably has an enlarged section 86 which functions as a finger grip for pulling the bolt 55 to its retracted position. The head 87 of the lock screw 85 is sized to engage the safety member 81 so as to limit movement of the safety member in the rearward direction. It will be understood, therefore, that lock screw 85 constitutes means for preventing seperation of the safety member 81 from the tailpiece 63.

Figure 7:
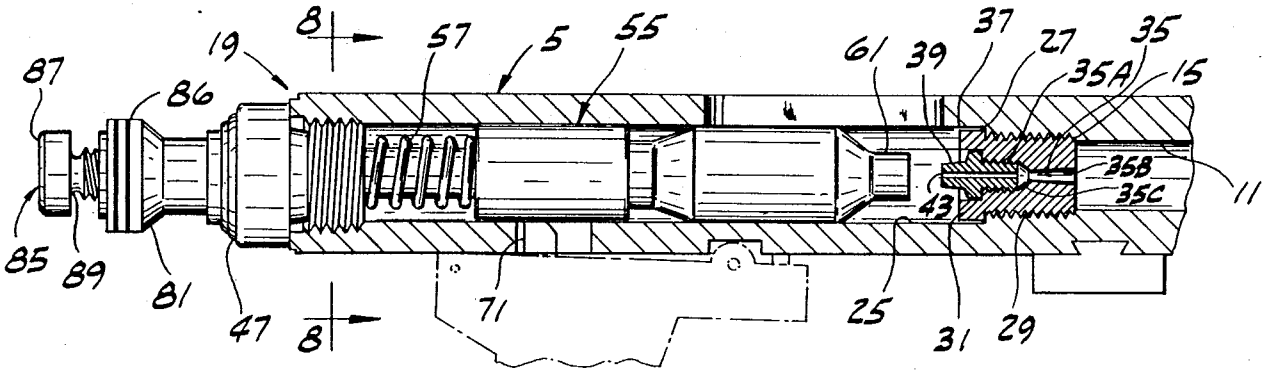
FIG. 7 is a view similar to FIG. 4 showing the safety in its engaged position with the bolt forward but the bolt head short of reaching the firing cap.

In FIGS. 4 and 6, the safety member 81 is in its disengaged position wherein the bolt is able to move to its firing position (FIG. 6). The safety member 81 may be rotated on the threaded portion 83 between its disengaged (FIGS. 4 and 6) and engaged positions (FIGS. 5 and 7). When the safety member 81 is in its engaged position forward of the disengaged position, it is engageable with the end cap 47 (FIG. 7) as the bolt 55 moves toward its firing position so as to limit the forward travel of the bolt and thereby prevent the bolt head 61 from reaching its firing position. Therefore, if the safety member 81 is in its engaged position, the rifle 1 is incapable of discharge. When the safety member is in its disengaged position, however, the rifle may be discharged (if the first safety is also disengaged).

Preferably, the position of the safety member 81 is indicated by color-code. For example, the threaded portion 83 of tailpiece 63 has a green stripe 89 toward its rearward end and a red stripe 91 spaced forward of the green stripe a suitable distance, the arrangement being such that when the safety member 81 is in its disengaged position (as shown in FIG. 4), it covers the green stripe but not the red stripe, indicating that the rifle is ready to discharge. Conversely, when the safety member 81 is in its engaged position (as shown in FIG. 5), the arrangement is such that it covers the red stripe but not the green stripe, indicating that the rifle cannot be discharged. Alternatively, the color-coding scheme could utilize a window, peep hole, or notch in the safety member 81 to indicate its position.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A muzzle-loading rifle comprising:

a barrel having an axial bore therethrough;

an elongate receiver formed integrally with said barrel at the breech end of the barrel, said receiver extending rearwardly from the barrel and having an axial bore therethrough generally coaxial with the bore through the barrel;

an end cap at the rearward end of the receiver having a bore therethrough generally coaxial with said receiver bore;

a bolt of integral one-piece construction slidable in the bore of the receiver between a retracted position and a firing position;

said bolt having a body, a head at the forward end of the body and an elongate tailpiece at the rearward end of the body extending endwise from the body through said end cap bore and projecting rearwardly beyond said end cap, said tailpiece forming a handle adapted to be grasped and pulled to slide the bolt, without rotating the bolt, to said retracted position;

spring means associated with the tailpiece of the bolt and reacting against the rearward end of the body of the bolt for urging said bolt forwardly toward its firing position; and means on the body of said bolt for receiving a trigger sear to hold the bolt in said retracted position against the urging of said spring means, said sear-receiving means being spaced forwardly of the forward end of said spring means a distance greater than the distance between the retracted and firing positions.

2. A muzzle-loading rifle as set forth in claim 1 wherein said sear-receiving means comprises an annular groove in the body of the bolt for receiving a trigger sear to hold the bolt in said retracted position against the urging of said spring means.

3. A muzzle-loading rifle as set forth in claim 1 further comprising a breech plug fastened to the bore of the barrel at the breech end of the barrel, said breech plug having a bore therethrough generally coaxial with said barrel and receiver bores, said bore through the breech plug having a first relatively large-diameter section adjacent the rearward end of the plug and a second relatively small-diameter section at the forward end of the plug.

4. A muzzle-loading rifle as set forth in claim 3 wherein said breech plug bore has a tapered transition section between said first and second bore sections.

5. A muzzle-loading rifle as set forth in claim 3 wherein said second bore section is funneled, being of larger diameter toward its forward end and of smaller diameter toward its rearward end.

6. A muzzle-loading rifle as set forth in claim 3 further comprising a nipple threadable into said first section of the bore through the breech plug, said nipple being adapted to hold a firing cap thereon in a position to be struck by the head of the bolt when the bolt moves to its firing position.

7. A muzzle-loading rifle as set forth in claim 6 wherein said breech plug has a wrench slot at the rear end of the breech plug whereby removal of the breech plug is facilitated.

8. A muzzle-loading rifle as set forth in claim 1, wherein said bolt head has a generally shallow recess in its forward end for containing the explosion of a firing cap received therein, the depth of the recess being such that the explosion of the firing cap is directed generally forwardly and the firing cap banana peels when the bolt reaches the firing position whereby flash back is suppressed and removal of the firing cap is facilitated.

9. A muzzle-loading rifle as set forth in claim 1 wherein said spring means comprises a spring reacting at one end against said end cap and at its other end against said bolt for urging the latter toward said firing position.

10. A muzzle-loading rifle as set forth in claim 1 wherein said end cap is threaded in a counterbore in the rearward end of said receiver.

11. A muzzle-loading rifle comprising:

a barrel having an axial bore therethrough;

a receiver at the breech end of the barrel having an axial bore therethrough generally coaxial with the bore through the barrel;

an end cap at the rearward end of the receiver having a bore therethrough generally coaxial with said receiver bore;

a bolt slidable in the bore of the receiver between a retracted position and a firing position;

said bolt having a body, a head at the forward end of the body and an elongate tailpiece at the rearward end of the body extending endwise from the body through said end cap bore and projecting rearwardly beyond said end cap, said tailpiece forming a handle adapted to be grasped and pulled to slide the bolt to said retracted position;

spring means for urging said bolt forwardly toward its firing position;

first safety means adapted to be actuated for preventing the bolt from moving from its retracted positon; and second safety means adapted to be actuated for preventing the bolt from reaching its firing position, said second safety means comprising a safety member rotatable on said bolt tailpiece between a disengaged position wherein the bolt is able to move to its firing position and an engaged position forward of the disengaged position wherein the safety member is engageable with said end cap as the bolt moves toward its firing position for limiting the forward travel of the bolt and thereby preventing it from reaching its firing position.

12. A muzzle-loading rifle as set forth in claim 11 further comprising means for preventing separation of the safety member from the tailpiece.

13. A muzzle-loading rifle as set forth in claim 11 further comprising color-coded means for indicating when the safety member is in said engaged and disengaged positions, the color-coded means including first and second circumferential stripes of different colors on said tailpiece adapted to indicate that said safety member is in said engaged and disengaged positions, respectively, said safety member being adapted to conceal said first color stripe but not said second color stripe when it is in said disengaged position and to conceal said second color stripe but not said first color stripe when it is in said engaged position.

14. A muzzle-loading rifle as set forth in claim 11 wherein said safety member has an enlarged section adapted to function as a finger grip for pulling said bolt rearwardly to said retracted position.

15. A muzzle-loading rifle comprising:

a barrel having an axial bore therethrough;

a receiver at the breech end of the barrel having an axial bore therethrough generally coaxial with the bore through the barrel; and a bolt assembly comprising an end cap detachably mounted at the rearward end of the receiver and having a bore therethrough generally coaxial with said receiver bore;

a bore slidable in the bore of the receiver between a retracted position and a firing position;

said bolt having a body, a head at the forward end of the body and an elongate tailpiece at the rearward end of the body extending endwise from the body through said end cap bore and projecting rearwardly beyond said end cap, said tailpiece forming a handle adapted to be grasped and pulled to slide the bolt, without rotating the bolt, to said retracted position;

spring means on the tailpiece reacting against said end cap and said body of the bolt for urging said bolt forwardly toward its firing position;

finger grip means toward the rearward end of said tailpiece for grasping the tailpiece to pull the bolt rearwardly to said retracted position; and safety means adapted to be actuated for preventing the bolt from reaching its firing position;

said end cap being adapted to be detached from said receiver whereby said bolt assembly may be removed as a unit from said rifle, said safety means being operable on the bolt regardless of whether the bolt assembly is detached or attached to the rifle.

16. A muzzle-loading rifle as set forth in claim 15, wherein said bolt head has a generally shallow recess in its forward end for containing the explosion of a firing cap received therein, the depth of the recess being such that the explosion of the firing cap is directed generally forwardly and the firing cap banana peels when the bolt reaches the firing position whereby flash back is suppressed and removal of the firing cap is facilitated.

17. A muzzle-loading rifle as set forth in claim 15 wherein the rearward end of said receiver is counterbored for threadably receiving said end cap.

* * * * *